United States Patent [19]

Kurz

[11] Patent Number: 4,467,625

[45] Date of Patent: Aug. 28, 1984

[54] TWO BAR WARP-KNITTED LOOP FABRIC

[76] Inventor: Milton Kurz, Pond Crossing, Lawrence, N.Y. 11559

[21] Appl. No.: 547,882

[22] Filed: Nov. 2, 1983

[51] Int. Cl.[3] ..... D04B 23/08; D04B 23/10

[52] U.S. Cl. ..... 66/193; 66/190; 66/191; 66/194

[58] Field of Search ..... 66/193, 190, 191, 194

[56] References Cited

U.S. PATENT DOCUMENTS

| | | | |
|---|---|---|---|
| 2,531,718 | 11/1950 | Rice | 66/191 |
| 2,899,813 | 8/1959 | Herrnstadt et al. | 66/193 |
| 2,934,924 | 5/1960 | Herrnstadt | 66/191 |
| 2,943,470 | 7/1960 | MacCaffray | 66/193 |
| 2,957,327 | 3/1959 | Glover | 66/191 |
| 3,183,685 | 5/1965 | Riehl | 66/193 |
| 3,349,575 | 10/1967 | Schwartz | 66/194 |
| 3,520,155 | 7/1970 | Koppeburg | 66/190 |
| 4,075,874 | 2/1977 | Hiemberger | 66/190 |

FOREIGN PATENT DOCUMENTS

| | | | |
|---|---|---|---|
| 1585096 | 7/1964 | Fed. Rep. of Germany | 66/190 |
| 54-15053 | 2/1979 | Japan | 66/193 |

*Primary Examiner*—Ronald Feldbaum
*Assistant Examiner*—Mary A. Ellis
*Attorney, Agent, or Firm*—Brumbaugh, Graves, Donohue & Raymond

[57] ABSTRACT

A two bar warp-knitted loop fabric comprises a ground of separate knitted warp chains formed by the front bar at half gauge and lay-ins formed by the back bar at full gauge in pattern repeats in which each lay-in thread forms at least three successive course-to-course free loops located alternately in the unoccupied positions on either side of a knitted warp chain followed by at least three successive course-to-course caught loops located alternately in adjacent warp chains.

1 Claim, 1 Drawing Figure

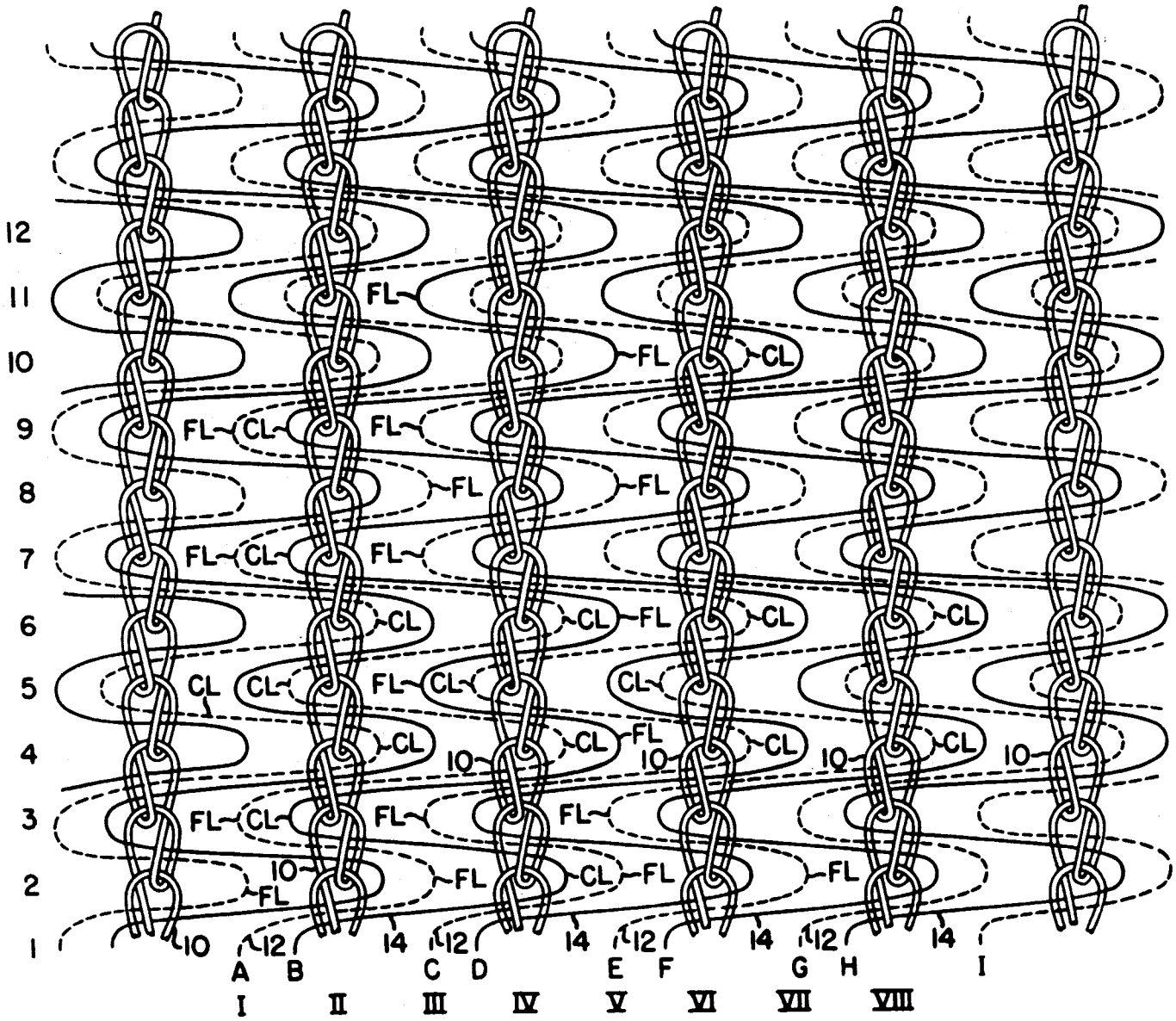
12
11
10
9
8
7
6
5
4
3
2
1
FL
CL
10
12
14
A
B
C
D
E
F
G
H
I
II
III
IV
V
VI
VII
VIII

TWO BAR WARP-KNITTED LOOP FABRIC

FIELD OF THE INVENTION

The present invention relates to fabrics and, in particular, to a two bar warp-knitted fabric having myriad free loops.

BACKGROUND OF THE INVENTION

Warp-knitted fabrics having comparatively loose or "free" loops are known, the most common example being the "loop cloth" component of hook and loop cloth, such as "Velcro". Such free loop knitted fabrics are made using three bars with the front and back bars knitting and the middle bar laying in with a large "run-in" so that the laps between courses of the lay-in threads are loose and protrude from the back of the fabric. Three-bar loop fabrics are relatively expensive because three-bar knitting is slow and uses a relatively large amount of thread for a given amount of fabric.

SUMMARY OF THE INVENTION

There is provided, in accordance with the present invention, a two-bar warp-knitted loop fabric. The invention has the advantages of being less costly than previously known loop fabrics. The fabric is of simple construction but still has good stability. Its principal use is as the loop cloth element of hook and loop cloth, but it can also be used for a substrate or backing in various applications, e.g., urethane foam backing, and in apparel, e.g., backing where high adhesive is required for second lamination.

In accordance with the invention a two-bar warp-knitted loop fabric comprises a ground of separate, knitted warp chains formed by the front bar at half gauge, thereby leaving unoccupied warp-wise positions, and lay-ins formed at full gauge in pattern repeats in which each lay-in thread forms at least three successive course-to-course free loops located alternately in the unoccupied positions on either side of a knitted warp chain followed by at least three successive course-to-course caught loops located alternately in adjacent knitted warp chains. Each segment of each lay-in thread between adjacent free loops is caught in an underlay of the knitted warp chain between the unoccupied positions in which such loops are located, and each segment of each lay-in thread between adjacent caught loops is caught in the underlays in the same course of the adjacent chains in which such loops are located. Every other lay-in thread forms free loops, while the remaining lay-in threads form caught loops in the same courses, and vice versa.

Examples of the knitting formulae for some embodiments of the present invention are:

Example 1 (six course repeat)
Front bar: 0/1 1/0
Back bar: 0/0 3/3 0/0 4/4 1/1 4/4
Example 2 (eight course repeat)
Front bar: 0/1 1/0
Back bar: 0/0 3/3 0/0 4/4 1/1 4/4 1/1 4/4
Example 3 (ten course repeat)
Front bar: 0/1 1/0
Back bar: 0/0 3/3 0/0 3/3 0/0 4/4 1/1 4/4 1/1 4/4

DESCRIPTION OF THE DRAWING

The drawing illustrates the back of the fabric formed by the knitting formula given above in Example 1.

DESCRIPTION OF THE EMBODIMENT

In the drawing the conventional labelling of courses in arabic numerals, wales by capital roman numerals and ends (threads) by capital letters is followed. For clarity the knitted warp chains are plain (no shading), alternate lay-in threads are hatched lines and the remaining lay-in threads are plain lines.

The fabric comprises a ground of warp chains 10 knitted at half-gauge from the front bar threads (threaded in; out), thereby leaving the odd-numbered warp positions I, III, V, etc. unoccupied by knitted warp chains. A first group of lay-in threads 12 consisting of every other end A, C, E, etc. of full gauge back bar guides follows a pattern repeat exemplified by end A, to wit: caught in underlap of knitted warp chain 10-II in course 1; forms a free loop FL in the unoccupied warp position III from course 1 to course 2; caught in the underlap of knitted warp chain 10-II in course 2; forms a free loop FL in the unoccupied warp position I from course 2 to course 3; caught in the underlap of knitted warp chain 10-II in course 3; lays in across unoccupied knitted warp chain position III in course 3; caught in the underlap of knitted warp chain 10-IV in course 3; forms a caught loop CL from course 3 to course 4 in knitted warp chain 10-IV; caught in the underlap of knitted warp chain 10-IV in course 4; lays-in across unoccupied warp position III in course 4; caught by the underlap of knitted warp chain 10-II in course 4; forms a caught loop CL from course 4 to course 5 in knitted warp chain 10-II; lays across the unoccupied position III from knitted warp chain 10-II to knitted warp chain 10-IV in course 5; caught in the underlap of knitted warp chain 10-IV in course 6; lays back across position III to knitted warp chain 10-II; caught in underlap of knitted warp chain 10-II in course 6; forms a free loop FL from course 6 to course 7 in the unoccupied warp position I. This ends one repeat of the pattern.

It will be observed that the remaining group of ends of the lay-in threads, 14B, 14D, 14F, etc., follow the same pattern but lead the first group (12A, 12C, 12E, etc.) by three courses. In other words, as the ends of the first group are forming free loops FL from course to course alternately in unoccupied warp positions on either side of every other knitted warp chain, the ends of the second group are forming caught loops from course to course alternately in adjacent knitted warp chains of the same courses. Thus, adjacent knitted warp chains are joined in every course by a lay-in thread that is caught in the respective knitted warp chains by a caught loop, which provides stability. Meanwhile, a free loop FL extends from course to course in every knitted warp chain, first toward the unoccupied position to one side and then to the other, thus to provide myriad free loops, one in every course and adjacent every occupied wale.

For most applications either the warp threads or the lay-in threads should have a relatively high surface; friction-spun yarns, texturized yarns, taslanized yarns or other rough-surfaced yarns are suitable. Surface friction helps lock the warp and lay-in systems together for stability. For maximum stability, both the knitted threads and lay-in threads may be of high surface friction types. In some applications, however, both the warp and lay-in threads may be low surface friction types. For example, a low level of stability may be desirable in order to facilitate compliance of the fabric to a complex shape.

In order to keep each free loop from being pulled through the underlap of warp chain as the next free loop is formed, the tension on the back bar threads has to be kept relatively low. Similarly, the front bar threads are run with high tension to improve the lock between the warp and lay-in systems.

The eight-course and ten-course repeat patterns provided by the formulae of Examples 2 and 3 above follow the same principle of the present invention as the example shown in the drawing. The only difference among the three examples is the number of courses traversed by a lay-in thread in the free loop mode before it switches to a caught loop mode, and vice versa. Thus, in Example 2, one group of lay-in threads forms three free loops and then five caught loops while the other group forms three caught loops and five free loops, both in succession in the pattern. In the ten-course repeat, Example 3, both groups of lay-ins form five free loops and then five caught loops in succession, the groups being offset in mode by five courses. In like manner, other patterns can readily be formulated according to the spirit and scope of the present invention by those skilled in the art.

I claim:

1. A two-bar warp-knitted loop fabric comprising a first group of threads forming warp chains knitted by the front bar threaded in; out, thereby leaving unoccupied warp positions between adjacent chains, and a second group of threads laid in from a fully threaded back bar in pattern repeats consisting of at least three successive course-to-course free loops located alternately in the unoccupied positions on either side of each warp chain followed by at least three successive course-to-course caught loops located alternately in adjacent chains, each segment of each lay-in thread between adjacent free loops being caught in an underlay of the warp chain between the unoccupied positions in which such loops are located, each segment of each lay-in thread between adjacent caught loops being caught by the underlays in the same course of the adjacent chains in which such loops are located, and every other lay-in thread forming free loops while the remaining lay-in threads form caught loops in the same courses and vice versa.

* * * * *